US011725653B2

(12) United States Patent
Jäggle et al.

(10) Patent No.: US 11,725,653 B2
(45) Date of Patent: Aug. 15, 2023

(54) PUMP INSERT AND PUMP ARRAY COMPRISING SUCH A PUMP INSERT

(71) Applicant: Schwäbische Hüttenwerke Automotive GmbH, Aalen-Wasseralfingen (DE)

(72) Inventors: Gerd Jäggle, Ertingen (DE); Michael Ehringer, Bad Schussenried (DE); Georg Wiebel, Wolpertswende (DE)

(73) Assignee: SCHWÄBISCHE HÜTTENWERKE AUTOMOTIVE GMBH

( * ) Notice: Subject to any disclaimer, the term of this patent is extended or adjusted under 35 U.S.C. 154(b) by 0 days.

(21) Appl. No.: 17/198,723

(22) Filed: Mar. 11, 2021

(65) Prior Publication Data

US 2021/0285443 A1 Sep. 16, 2021

(30) Foreign Application Priority Data

Mar. 12, 2020 (DE) ..... 10 2020 106 796.8

(51) Int. Cl.
*F04C 11/00* (2006.01)
*F04C 2/08* (2006.01)
(Continued)

(52) U.S. Cl.
CPC ..... *F04C 11/008* (2013.01); *F04C 2/08* (2013.01); *F04C 2/10* (2013.01); *F04C 2/102* (2013.01); *F04C 15/00* (2013.01); *F04C 15/0096* (2013.01); *F04C 15/06* (2013.01); *F04C 29/047* (2013.01); *F04C 2240/20* (2013.01); *F04C 2240/30* (2013.01); *F04C 2240/40* (2013.01);
(Continued)

(58) Field of Classification Search
CPC .. F04C 11/008; F04C 15/0096; F04C 29/047; F04C 2240/808
See application file for complete search history.

(56) References Cited

U.S. PATENT DOCUMENTS 10,077,781 B2 * 9/2018 Irie ..... F04D 29/5813
2012/0128513 A1 * 5/2012 Sakata ..... F04C 2/086 417/410.1
(Continued)

FOREIGN PATENT DOCUMENTS

DE 19646617 A1 5/1998
DE 10151706 A1 9/2002
(Continued)

OTHER PUBLICATIONS

Search Report for German patent application No. 10 2020 106 796.8, dated Jan. 22, 2021, 10 pages.

*Primary Examiner* — Laert Dounis
(74) *Attorney, Agent, or Firm* — Luedeka Neely Group, PC

(57) ABSTRACT

A pump insert (1) for arranging in an accommodating space (104), the pump insert (1) comprising: a pump (10) comprising a pump chamber (15) and a delivery element (11) which can rotate about a rotational axis (D) and which is arranged in the pump chamber (15); an electric motor (20) comprising a rotor (21), which can rotate about the rotational axis (D), and a stator (22); and a drive shaft (30) which is mounted such that it can rotate about the rotational axis (D), wherein the rotor (21) and the delivery element (11) are connected via the drive shaft (30) in such a way that rotating the rotor (21) causes the delivery element (11) to rotate.

25 Claims, 3 Drawing Sheets

Figure 1:
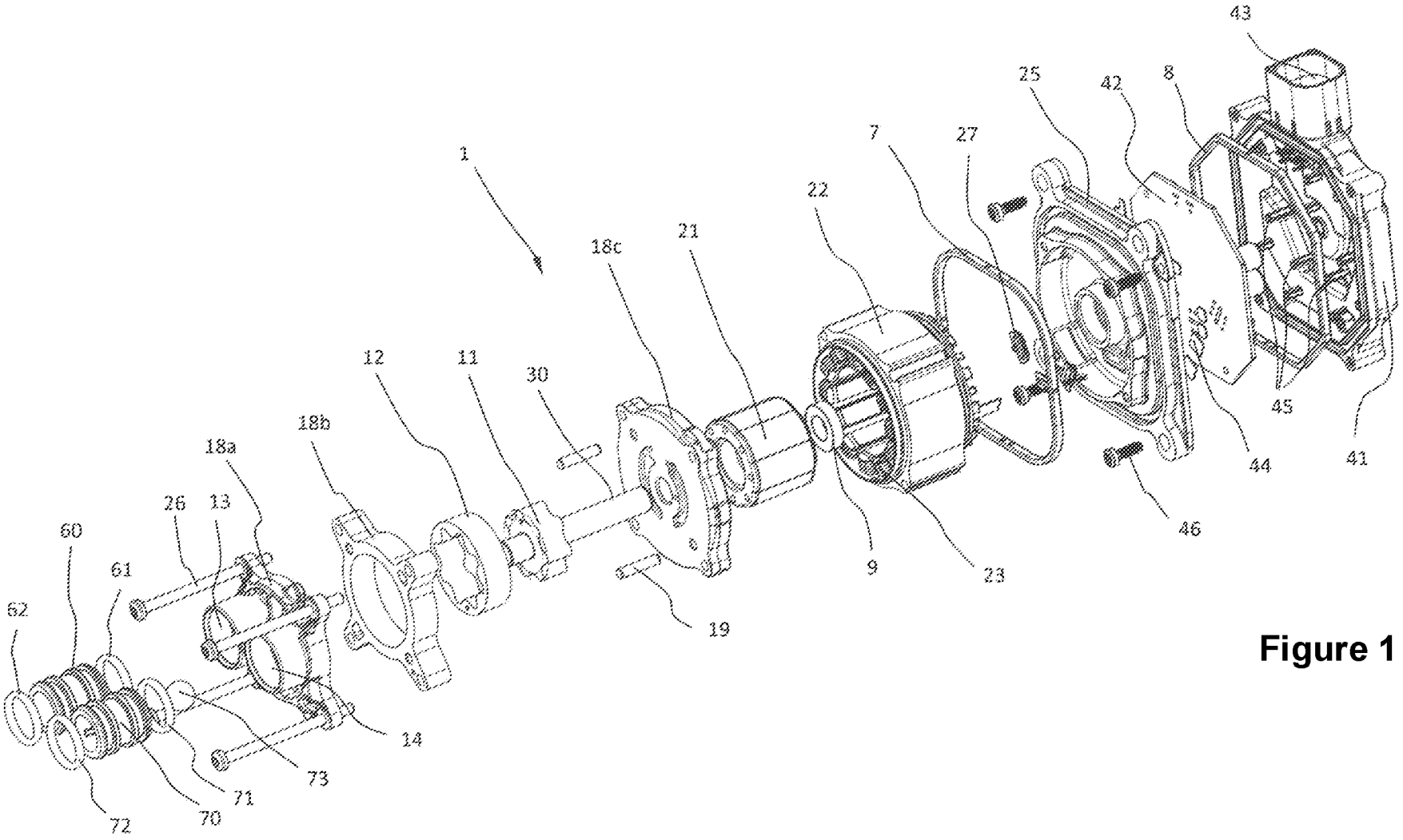

(51) Int. Cl.

| | |
|---|---|
| ***F04C 15/00*** | (2006.01) |
| ***F04C 29/04*** | (2006.01) |
| ***F04C 2/10*** | (2006.01) |
| ***F04C 15/06*** | (2006.01) |

(52) U.S. Cl.
CPC .... *F04C 2240/60* (2013.01); *F04C 2240/808* (2013.01)

(56) References Cited

U.S. PATENT DOCUMENTS

| | | | | |
|---|---|---|---|---|
| 2014/0054991 | A1* | 2/2014 | Hyodo | F04C 15/008 310/71 |
| 2014/0241917 | A1* | 8/2014 | Suzuki | F04C 11/008 417/410.4 |
| 2016/0281712 | A1* | 9/2016 | Muizelaar | F04C 11/008 |

FOREIGN PATENT DOCUMENTS

| | | | | |
|---|---|---|---|---|
| DE | 202004010513 | U1 | 11/2005 | |
| DE | 102007016255 | A1 | 11/2007 | |
| DE | 102012219841 | A1 * | 10/2013 | F01C 21/10 |
| DE | 102015119263 | A1 | 4/2017 | |
| DE | 102016202226 | A1 | 8/2017 | |
| DE | 102019130719 | A1 * | 5/2021 | |
| EP | 1482175 | A2 | 12/2004 | |
| EP | 2463556 | A1 | 6/2012 | |
| EP | 3098382 | A1 * | 11/2016 | F01C 21/10 |
| FR | 2480867 | A1 * | 10/1981 | |
| JP | 2011094553 | A * | 5/2011 | |
| JP | 5431872 | B2 | 3/2014 | |
| WO | 2009149682 | A2 | 12/2009 | |
| WO | WO-2019001200 | A1 * | 1/2019 | B62D 5/06 |

* cited by examiner

PUMP INSERT AND PUMP ARRAY COMPRISING SUCH A PUMP INSERT

This application claims the benefit of the earlier filing date of German patent application 10 2020 106 796.8, filed Mar. 12, 2020.

The invention relates to a pump insert for arranging in an accommodating space. The pump insert arranged in the accommodating space forms a pump array. The pump insert forms a pump-motor unit with an electric motor for driving the pump. The pump and the electric motor together form a unit. The pump can be a liquid pump, for example an oil or fuel pump. The pump-motor unit can for example supply a hydraulic motor or a gear system, such as for example a vehicle gear system or a gear system of a motor vehicle, with fluid, in particular in order to lubricate and/or cool and/or actuate components of the gear system. It can for example form a gear unit with the gear system or can be fastened to a gear system or at least connected to the gear system in terms of flow dynamics, in particular in fluid communication. In principle, the pump-motor unit can be used to supply an internal combustion engine, in particular an internal combustion engine of a motor vehicle, with fluid, in particular for lubricating and/or cooling.

Pumps of this design are known for example from EP 3 081 741 A2. Pumps which are driven by an electric motor are also known.

In accordance with one aspect, the invention is based on the object of providing a pump insert and a pump array in which thermal management is improved.

This object is achieved by the pump insert according to claim 1 and the pump array according to claim 10. Advantageous developments follow from the dependent claims, the description and the figures.

A pump array in accordance with the invention comprises: an accommodating housing which forms an accommodating space, in particular a cup-shaped accommodating space, with an end-facing wall and a circumferential wall; and a pump insert which is or can be at least partially arranged in the accommodating space. The accommodating space can be sealed at one end by the end-facing wall which for example adjoins the circumferential wall for this purpose. At one end, in particular the end opposite the end-facing wall, the accommodating space can be sealed by the pump insert, in particular an assembly structure of the pump insert. The accommodating space can in particular be sealed off from the outside, for example by means of a gasket or sealing element which can be arranged between the accommodating housing and the pump insert, in particular the assembly structure of the pump insert.

The pump comprises a pump chamber and a delivery element which can rotate about a rotational axis and which is arranged in the pump chamber. The pump can be embodied as a fluid pump, in particular a liquid pump. The pump can for example be a toothed wheel pump, in particular an internally toothed wheel pump or an externally toothed wheel pump, a rotary vane pump, a vane cell pump or a pendulum-slider pump. Such pumps comprise a rotatable rotor which, in order to avoid confusion with the rotor of the electric motor described later, is referred to here as a delivery element or first delivery element. The pump is configured to deliver fluid from an inlet or inlet channel to an outlet or outlet channel, in particular via the pump chamber. The inlet can for example comprise the inlet channel, via which fluid can flow towards the pump chamber, and the outlet can for example comprise the outlet channel via which fluid can be discharged from the pump chamber. The inlet or inlet channel and the outlet or outlet channel can be formed by a pump housing of the pump insert, which can be embodied in one or more parts.

The pump chamber can be formed, in particular enclosed or delineated, by the pump housing. The housing base body can for example form a hollow space which corresponds to the pump chamber and which can be covered on one side by a housing cover. The delivery element, in particular the first delivery element, can form a sealing gap with the housing base body on one end-facing side (a first end-facing side) of the pump chamber, and the delivery element, in particular the first delivery element, can form a sealing gap with the housing cover on the other end-facing side (a second end-facing side) of the pump chamber. Alternatively, the delivery element, in particular the first delivery element, can form a sealing gap with a first housing cover on one end-facing side (a first end-facing side) of the pump chamber, and the delivery element, in particular the first delivery element, can form a sealing gap with another, second housing cover on the other end-facing side (a second end-facing side) of the pump chamber.

The delivery element, in particular the first delivery element, can rotate about a rotational axis relative to the housing, in particular the housing base body and/or the first and/or second housing cover, or rotates about said rotational axis during operation.

At least one other delivery element, for example a second delivery element, can for example be arranged in the pump chamber. The first delivery element can for example be a pinion or a toothed wheel having an external toothed profile, wherein the second delivery element can be a ring gear having an internal toothed profile which engages the external toothed profile of the first delivery element. The outer diameter of the first delivery element can be smaller than the inner diameter of the second delivery element. The external toothed profile of the first delivery element can for example comprise a smaller number of teeth than the internal toothed profile of the second delivery element. The second delivery element can be rotatable about another rotational axis which is or can be offset in parallel with respect to the rotational axis of the first delivery element. Rotating the first delivery element causes the second delivery element to be rotated about another rotational axis, wherein the rotational speed of the second delivery element is lower than the rotational speed of the first delivery element.

The pump insert comprises an electric motor which can for example be arranged on the end-facing side of the pump. The electric motor comprises a rotor, which can rotate about the rotational axis, and a stator. The stator of the electric motor can for example at least partially or completely surround the rotor of the electric motor. The electric motor can in particular be embodied as an internal-rotor motor. Alternatively, the rotor can at least partially surround the stator. The electric motor can in particular be embodied as an external-rotor motor. The stator can for example comprise multiple coils, in particular stator coils. The coils are for example embodied as a multi-phase system, in particular a three-phase system. Each phase can comprise multiple coils. The coils and/or each phase can be actuated by a suitable switch or controller, such that the coils generate a magnetic field which moves in the rotational direction of the rotor, causing the rotor to rotate about its rotational axis. The rotor can for example comprise one or more magnets, in particular permanent magnets, which interact with the magnetic field generated by the coils. The electric motor can in particular be embodied as a brushless direct current motor.

The pump insert also comprises a drive shaft which is mounted such that it can rotate about the rotational axis of the rotor and/or the (first) delivery element, wherein the rotor of the electric motor and the (first) delivery element of the pump are connected via the drive shaft, such that rotating the rotor causes the delivery element to rotate.

The drive shaft can for example be embodied in one part and/or can extend from the rotor up to the (first) delivery element. The drive shaft can in particular extend through the rotor and/or through the pump chamber or the first delivery element.

The pump insert can comprise an assembly structure, for example a plate-shaped assembly structure, using which the pump insert can be fastened to the accommodating housing. The assembly structure can for example form a flange which is supported on the accommodating housing. The assembly structure, in particular the flange of the assembly structure, can be fastened to the accommodating housing by one or more fastening means, for example stud-bolts. The accommodating housing can for example exhibit an internal thread into which an external thread of the fastening means is screwed. The assembly structure, in particular the flange of the assembly structure, can for example be clamped between the accommodating housing and a head of the fastening means or a bolt nut arranged on the fastening means.

The assembly structure can for example be formed from metal or a metal alloy. The metal can for example be aluminum, or the metal alloy can for example be based on aluminum or magnesium. The accommodating housing and the assembly structure can be formed from the same metal or metal alloy or from different metals or metal alloys.

The assembly structure can form a cover which closes off the accommodating space. Alternatively or additionally, a gasket—in particular, an annular gasket—which seals off the accommodating space from the outside, i.e. from the environment, can be arranged between the assembly structure and the accommodating housing. The gasket which is in particular an annular gasket can abut an end-facing surface of the flange or assembly structure and an opposing end-facing surface of the accommodating housing, forming a seal. The gasket can for example be arranged in at least one recess formed on one of the opposing end-facing surfaces and abut a surface of the recess, forming a seal.

The pump insert can comprise control electronics for controlling the electric motor. The control electronics can be arranged on a side of the assembly structure facing away from the electric motor and/or outside the accommodating space. The assembly structure can for example be arranged between the electric motor and the control electronics. The assembly structure can for example close off the electric motor or the motor space of the electric motor on the end-facing side. The assembly structure can in particular delineate the motor space, which is at least partially enclosed by the stator, on the end-facing side. The stator and/or rotor can in particular be arranged between the assembly structure and the pump. The pump or pump housing can delineate the motor space on the end-facing side on the side facing away from the assembly structure.

A thermal bridge can be formed between the control electronics and the assembly structure, via which heat can be transmitted from the control electronics to the assembly structure. The thermal bridge is in particular adapted such that the transmission of heat is sufficient to substantially, in particular mostly, discharge the heat generated by the control electronics during operation via or into the assembly structure.

The assembly structure can for example comprise cooling fins which can dissipate the thermal energy discharged into the assembly structure from the control electronics via the thermal bridge. The cooling fins can for example be formed on the assembly structure such that the thermal energy can be dissipated to the environment, i.e. to a region outside the accommodating space, for example to the ambient air. Alternatively or additionally, cooling fins of the assembly structure can be arranged such that they can dissipate thermal energy into the motor space or the accommodating space, for example to a fluid or liquid contained therein. The pump insert or the pump array can for example be embodied such that fluid flows through the pump space and/or the accommodating space, wherein it can pass over a surface of the assembly structure, for example a surface of the cooling fins, thus enabling thermal energy to be discharged from the assembly structure into the fluid.

Alternatively or additionally, thermal energy can be channeled away or transferred from the assembly structure into the accommodating housing, in particular by means of a thermal bridge formed between the assembly structure and the accommodating housing, as will be described further below.

At least one thermally conductive element, in particular thermally conductive paste or a thermally conductive pad, can be arranged between the control electronics and the assembly structure. The at least one thermally conductive element can for example be arranged at least in the regions between the control electronics and the assembly structure in which the control electronics comprise component parts which require heat discharge or cooling during operation. The control electronics can be arranged at least partially on a carrier, for example a printed circuit board. In the region of (each of) one or more components or component parts of the control electronics, a thermally conductive element can be arranged between the component and the assembly structure. Alternatively or additionally, one or more thermally conductive elements can be arranged between the carrier and the assembly structure. It is generally preferred if the thermally conductive element abuts a surface of the assembly structure and a surface of the component of the control electronics to be cooled or the printed circuit board.

The thermally conductive element enables or at least improves the transfer of heat between the control electronics and the assembly structure.

In developments, the pump insert can comprise an electronics housing which is for example formed from metal, a metal alloy or plastic. The electronics housing can be fastened to the assembly structure and/or enclose an interior space. The interior space can be sealed off in relation to the outer side and/or surroundings, for example by means of a gasket, in particular a sealing ring, which is arranged between the electronics housing and the assembly structure and in particular abuts it, forming a seal. The control electronics can be arranged in the electronics housing, in particular in the interior space, or surrounded by the electronics housing. The control electronics, in particular the carrier, can be arranged, in particular in the interior space, between the assembly structure and the electronics housing. The electronics housing can for example be designed to protect the control electronics from external influences.

The electronics housing, such as for example one or more hold-down elements of the electronics housing, can press the carrier, in particular a printed circuit board, on which the control electronics are at least partially arranged, against or onto the assembly structure. The electronics housing, or the hold-down elements of the electronics housing, can for example abut the carrier. The electronics housing can for example abut the carrier in one or more regions, for example by means of a hold-down element in each case, wherein the regions can lie on the edges and/or between the edges. The at least one hold-down element means that the carrier or components of the control electronics are pressed against the assembly structure or the thermally conductive element(s), thus improving the transfer of heat between the control electronics and the assembly structure.

One or more of the hold-down elements can for example be pin-shaped, fin-shaped, tiered or the like. The at least one hold-down element can in particular be formed monolithically with the electronics housing, for example by manufacturing the electronics housing together with the at least one hold-down element from plastic in an injection-molding process or from a metal alloy in a die-casting process. The at least one hold-down element can project towards the carrier from an end-facing side of the electronics housing facing the carrier, for example in the shape of a pin, and abut the carrier.

In developments, the assembly structure can comprise a passage or at least one passage through which at least one contact element extends which electrically contacts the electronics unit and at least one coil of the stator. The contact element can be part of the electronics unit and protrude from the electronic unit or the carrier of the electronic unit into the motor space through the passage. Alternatively, the at least one contact element can be formed on the stator and protrude from the stator to the electronics unit through the passage. A complementary contact element, which is correspondingly formed by the stator or by the electronics unit and can be contacted and/or plugged together to form a plug connection with the contact element, is provided for the contact element. The passage through which the at least one contact element extends can be sealed off for example by means of a sealing compound or potting compound, a gasket or the like, such that the motor space and the control electronics are separated from each other in a material seal.

In embodiments, the pump housing—for example, the (second) housing cover—can comprise a (second) rotary bearing, at least between the electric motor and the pump space, via which the drive shaft is supported on the pump housing such that it can rotate about the rotational axis.

Optionally, the pump housing—for example, the (first) housing cover—can comprise another (first) rotary bearing, in particular on the side of the pump space facing away from the motor space, via which the drive shaft is supported on the pump housing such that it can rotate about the rotational axis. Alternatively or additionally, the drive shaft can be supported on the assembly such that it can rotate about the rotational axis, in particular by means of another (third) rotary bearing. The rotary bearings described here can for example be slide bearings or roll bearings. Slide bearings can be preferred for the rotary bearing or bearings via which the drive shaft is supported on the pump housing. The rotary bearing via which the drive shaft is supported on the assembly structure can for example be a slide bearing or a roll bearing.

In developments, a thermal bridge can be formed between the assembly structure and the accommodating housing, via which heat can be transmitted from the assembly structure to the accommodating housing. The thermal bridge can for example be formed between the accommodating housing and the flange via which the assembly structure and therefore the pump insert is fastened to the accommodating housing.

The assembly structure can for example directly abut the accommodating housing. Alternatively, a thermally conductive element—in particular, a thermally conductive paste or pad—can be arranged between the assembly structure and the accommodating housing. This improves the transfer of heat between the assembly structure and the accommodating housing as compared to embodiments in which the assembly structure directly abuts the accommodating housing.

The thermal bridge formed between the assembly structure of the pump insert and the accommodating housing, the assembly structure and the thermal bridge formed between the assembly structure and the control electronics embodied to control the electric motor can for example be adjusted to each other such that heat generated in the control electronics while the electric motor is in operation is or can be at least mostly discharged into the accommodating housing via the thermal bridge formed between the control electronics and the assembly structure, the assembly structure and the thermal bridge formed between the assembly structure and the accommodating housing. This advantageously enables the heat generated in the control electronics or in individual components of the control electronics during operation to be discharged into the accommodating housing, thus achieving advantageous heat management.

In embodiments, the pump insert can be embodied such that fluid, in particular leakage fluid, can be discharged from the pump space into the motor space through at least one of the rotary bearings via which the drive shaft is supported such that it can rotate. The pump insert can for example be embodied such that leakage fluid can be discharged from the pump chamber into the motor space through the rotary bearing which is formed, for example as a slide bearing, between the pump chamber and the electric motor. In embodiments, the pump insert can be embodied such that leakage fluid can be discharged from the pump chamber directly into the accommodating space or into the motor space through the rotary bearing, for example slide bearing, which is arranged on the side of the pump chamber facing away from the electric motor. Alternatively or additionally, the drive shaft can comprise a passage through which the leakage fluid can be discharged into the motor space.

The pump insert, for example the assembly structure or the stator or the pump housing, can comprise a motor space outlet which can for example be embodied in the shape of a channel and which connects the motor space in fluid communication with the outer side of the pump insert and/or with the accommodating space. The motor space outlet can emerge onto the outer side, in particular the outer circumference, of the pump insert and/or into the accommodating space. The motor space is surrounded by the stator on the circumferential side. By connecting the motor space to the outer circumference of the pump insert and/or to the accommodating space, the pump insert is embodied such that fluid can be discharged onto the outer circumference of the pump insert or onto the accommodating space from the motor space via the motor space outlet. This can in particular enable the leakage fluid discharged from the pump chamber into the motor space to be discharged onto the outer circumference of the pump insert or into the accommodating space between the pump insert and the circumferential wall of the accommodating space.

In embodiments, the motor space outlet or motor space outlet channel can be arranged laterally, i.e. on the circumferential side, on the pump insert. Alternatively or additionally, the motor space outlet can emerge onto the outer side of the pump insert, in particular the assembly structure, the stator or the pump housing via a motor space outlet opening pointed towards the circumferential wall of the accommodating space formed by the accommodating housing.

The accommodating housing can comprise a discharge channel which emerges into the accommodating space and through or via which fluid can be discharged from the accommodating space, in particular towards a storage container. The pump array is thus embodied to discharge fluid, which is discharged from the motor space into the accommodating space via the motor space outlet during operation, from the accommodating space to for example the storage container.

In embodiments, the pump insert can comprise an inlet which is embodied to feed fluid to the pump chamber and/or an outlet which is adapted to discharge fluid from the pump chamber. The accommodating space can in particular be sealed in relation to the inlet and the outlet, for example by means of one or more sealing elements. The inlet and the outlet can be sealed off in relation to each other, in particular by means of the at least one sealing element.

The pump insert can preferably comprise the inlet and the outlet on the side, in particular the end-facing side, which points towards the end-facing wall of the accommodating space. The inlet can be formed by an inlet channel, an opening of which points towards the end-facing side of the pump insert which points towards the end-facing wall of the accommodating space. The inlet opening and an opening of a feed channel formed by the accommodating housing can point oppositely towards each other.

The outlet can be formed by an outlet channel, an opening of which pointing towards the end-facing wall of the accommodating space points towards the end-facing side of the pump insert. The outlet opening and an opening of a drainage channel formed by the accommodating housing can point oppositely towards each other.

The accommodating housing can comprise the feed channel, which is connected in fluid communication with the inlet of the pump insert, and the drainage channel which is connected in fluid communication with the outlet of the pump insert. The accommodating housing can in particular form the feed channel and the drainage channel on its end-facing wall, i.e. the end-facing wall towards which the side of the pump insert comprising the inlet and/or the outlet points.

The pump array can comprise a connecting element which is for example tubular and which is arranged between the feed channel and the inlet and connects them in fluid communication. Alternatively or additionally, the pump array can comprise a connecting element which is for example tubular and which is arranged between the drainage channel and the outlet and connects them in fluid communication. The tubular connecting element can for example be formed by the pump housing, in particular the (first) housing cover. The tubular connecting element is preferably a part which is separate from the pump housing, in particular the (first) housing cover and the accommodating housing. This tubular connecting element can for example be inserted into the inlet, and another tubular connecting element can be inserted into the outlet. The at least one tubular connecting element can for example be held on the pump housing, for example in a frictional fit. A sealing element can in particular be provided which seals off a sealing gap between the tubular connecting element and the inlet and/or between the tubular connecting element and the outlet.

For assembling the pump array, a connecting element for each of the inlet and the outlet can be arranged on the pump insert. The pump insert which is fitted with the connecting elements can be handled as a unit and can be inserted into the accommodating space of the accommodating housing. The fluid-communication connection between the feed channel and the inlet and the fluid-communication connection between the drainage channel and the outlet can for example be established while inserting the pump insert, in particular by axially inserting the connecting elements into the feed channel and/or discharge channel.

The connecting element which connects the feed channel and the inlet in fluid communication can for example be inserted or able to be inserted into the feed channel. A sealing element, in particular a sealing ring, can be arranged between the connecting element, in particular an outer circumferential surface of the connecting element, and the feed channel, in particular an inner circumferential surface of the feed channel, and seal off the feed channel in relation to the accommodating space. The sealing element can abut the outer circumferential surface and the inner circumferential surface, forming a seal. The connecting element which connects the feed channel to the inlet can in particular extend through the accommodating space.

The connecting element which connects the drainage channel and the outlet in fluid communication can for example be inserted or able to be inserted into the drainage channel. A sealing element, in particular a sealing ring, can be arranged between the connecting element, in particular an outer circumferential surface of the connecting element, and the drainage channel, in particular an inner circumferential surface of the drainage channel, and seal off the drainage channel in relation to the accommodating space. The sealing element can abut the outer circumferential surface and the inner circumferential surface, forming a seal. The connecting element which connects the drainage channel to the outlet can in particular extend through the accommodating space.

It is generally preferred if the stator of the pump insert forms at least a part of the outer circumference or the outer side of the pump insert and/or delineates the accommodating space. In other words, the pump insert does not comprise an outer housing in preferred embodiments.

Figure 2:
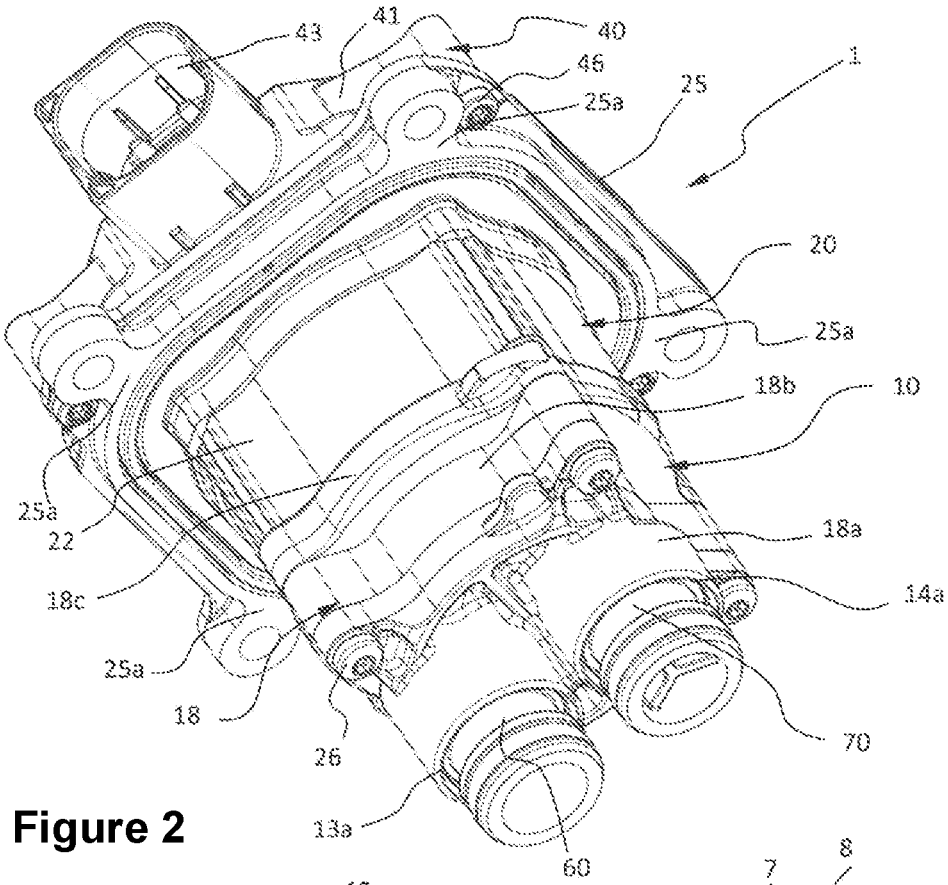
Figure 3:
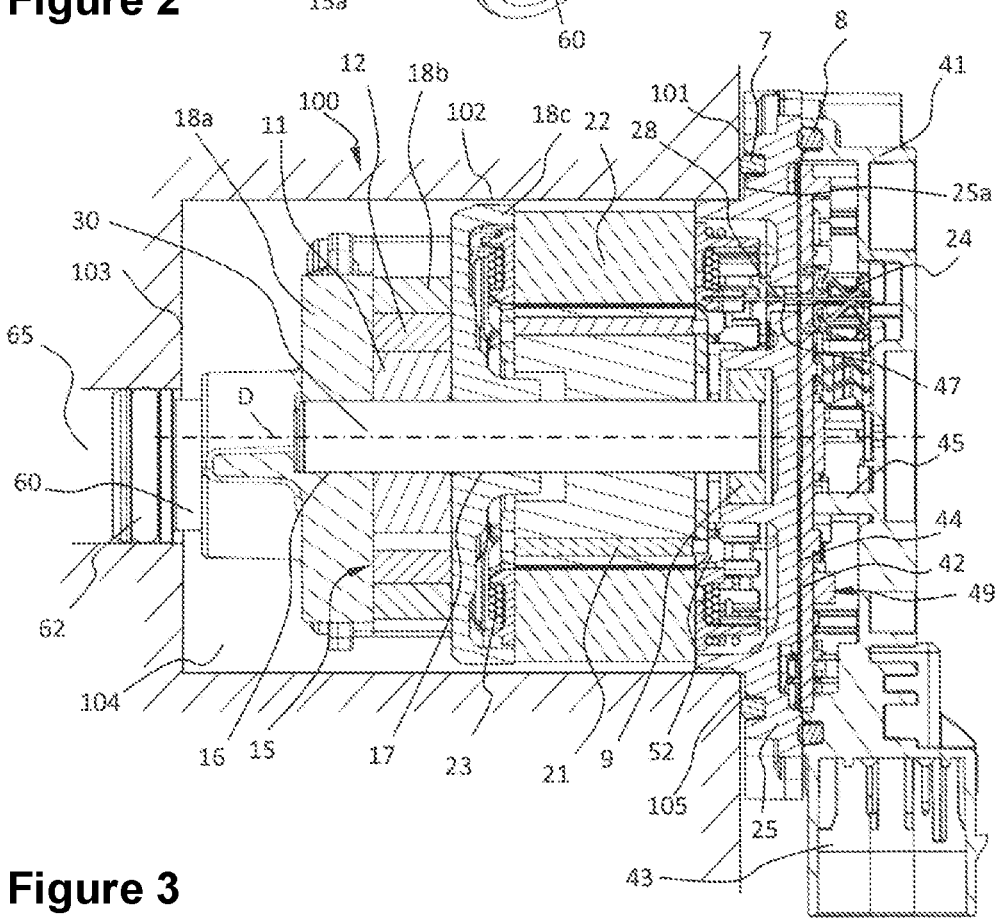
Figure 4:
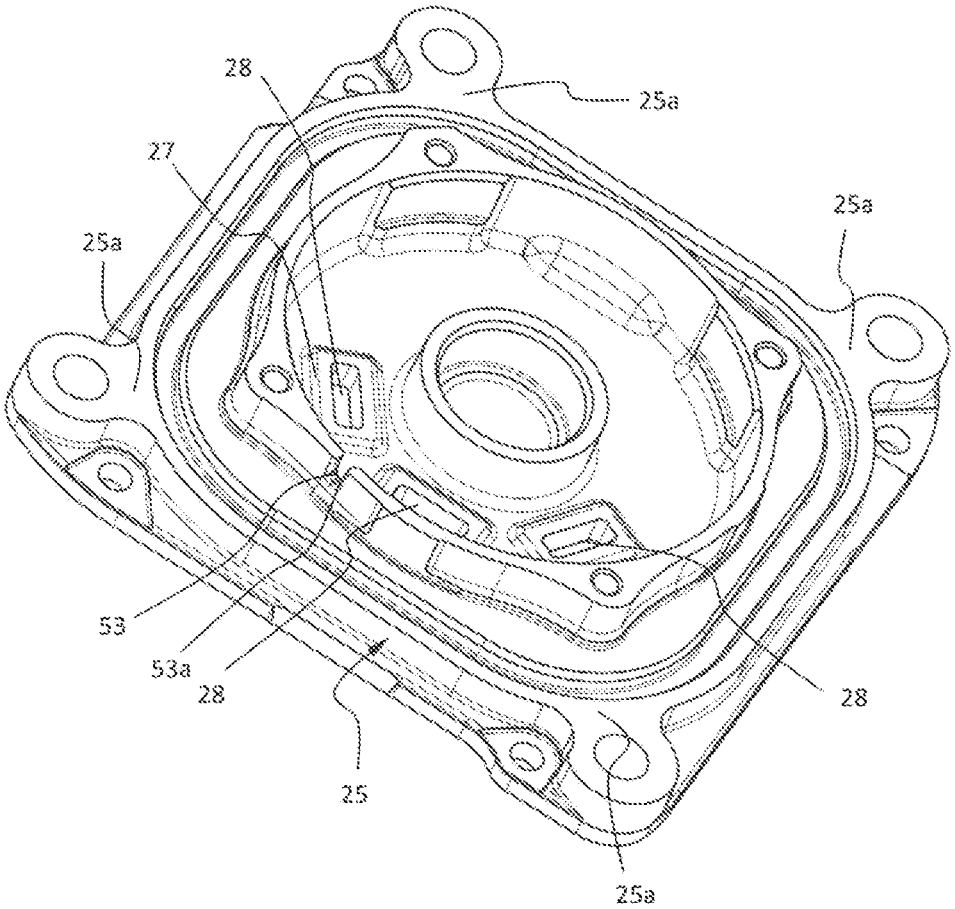

The invention has been described on the basis of multiple embodiments and examples. In the following, the invention is described on the basis of figures. The features thus disclosed, individually and in any combination of features, advantageously develop the invention. There is shown:

FIG. 1 an exploded representation of a pump insert in accordance with the invention;

FIG. 2 a perspective representation of the pump insert from FIG. 1;

FIG. 3 a pump array comprising an accommodating housing with the pump insert according to FIGS. 1 and 2 inserted in it;

FIG. 4 an assembly structure of the pump insert; and

Figure 5:
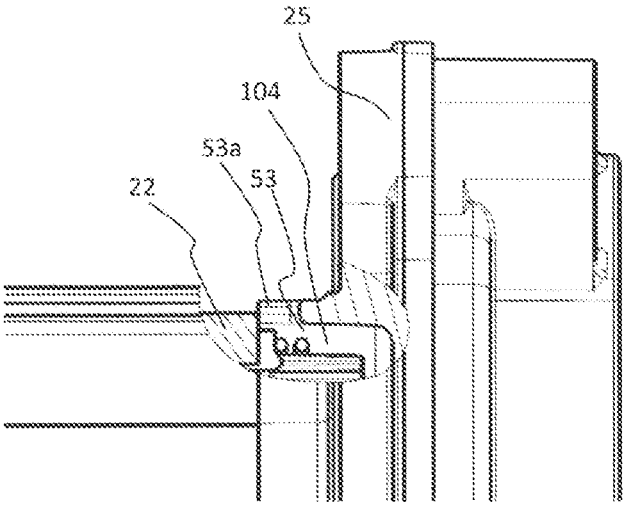

FIG. 5 a partial section of the assembly structure and the stator which shows a motor space outlet.

The pump insert 1 shown in FIGS. 1 to 3 comprises a pump 10 and an electric motor 20 which is arranged on or fastened to the end-facing side of the pump 10 or a pump housing 18 of the pump 10. The pump 10 comprises a pump housing 18 which comprises: a housing base body 18*b*; a first housing cover 18*a* which is fastened to the end-facing side of the housing base body 18*b*; and another, second housing cover 18*c*. The housing cover 18*c* is attached to the end-facing side of the housing base body 18*b* which points towards the electric motor 20. The housing cover 18*c* is arranged between the electric motor 20, in particular a stator 22 of the electric motor 20, and the housing base body 18*b*. The housing cover 18*a* is attached on the other end-facing side of the housing base body 18*b*, i.e. the end-facing side facing away from the electric motor 20. In the example shown, the housing base body 18*b* is arranged between the housing covers 18*a*, 18*b*. As an alternative to the embodiment shown, either the housing cover 18*a* or the housing cover 18*c* can be formed in one part, i.e. monolithically, with the housing base body 18*b*. The housing covers 18*a*, 18*b* and the housing base body 18*b* can be centered or positioned correctly relative to each other by means of at least one centering pin 19.

As can be seen for example from FIG. 3, the pump housing 18 forms a pump chamber 15 which comprises a cylindrical inner circumferential wall. The pump chamber 15 is axially delineated on one end-facing side by the housing cover 18*a* and on the other end-facing side by the housing cover 18*c*. A first delivery element 11 and a second delivery element 12 are arranged in the pump chamber 15. The first delivery element 11 is formed as an externally toothed wheel and is non-rotationally connected to a drive shaft 30, for example by means of a shaft-hub connection or an interference fit. The first delivery element 11 and the drive shaft 30 can rotate together about a rotational axis D relative to the housing 18. The first delivery element 11 forms a sealing gap with each of the housing cover 18*a* and the housing cover 18*c*.

The second delivery element 12 is formed as an internally toothed wheel or ring gear having an internal toothed profile and is mounted such that it can rotate by the inner circumferential surface of the housing base body 18*b*. The second delivery element 12 can rotate about a rotational axis which is arranged offset in parallel with respect to the rotational axis D. The internal toothed profile of the second delivery element 12 is in meshing engagement with the external toothed profile of the first delivery element 11 at one point on the circumference. The external toothed profile of the first delivery element 11 comprises fewer teeth than the internal toothed profile of the second delivery element 12. The outer diameter of the first delivery element 11 is smaller than the inner diameter of the second delivery element 12. The rotational speed ratio between the first delivery element 11 and the second delivery element 12 is such that the first delivery element 11 rotates at a greater rotational speed around the rotational axis D than the second delivery element 12 rotates about its rotational axis which is offset in parallel with respect to the rotational axis D. The second delivery element 12 forms a sealing gap with each of the first housing cover 18*a* and the second housing cover 18*c*.

The pump housing 18—as shown in this example, the housing cover 18*a*—forms an inlet 13, in particular an inlet channel, and an outlet 14, in particular an outlet channel. The inlet 13 is embodied such that fluid, in particular oil, can flow into the pump chamber 15. The outlet 14 is embodied such that fluid, in particular oil, which is delivered by the first and second delivery elements 11, 12 while the pump is in operation, is drained out of the pump chamber 15. The inlet 13 and the outlet 14 are each formed as a channel. An inlet opening 13*a* of the inlet 13 and an outlet opening 14*a* of the outlet 14 point towards the side of the housing cover 18*a* which points towards an end-facing wall 103 (FIG. 3) of an accommodating space 104. The pump insert 1 is at least partially arranged in the accommodating space 104 which forms the end-facing wall 103 and a circumferential wall 102. The accommodating space 104, which is in particular a cup-shaped accommodating space 104, is formed by an accommodating housing 100 (FIG. 3).

The accommodating housing 100 comprises a feed channel 65, a feed channel opening of which emerges onto the end-facing wall 103. The accommodating housing 100 also comprises a drainage channel, a drainage channel opening of which opens onto the end-facing wall 103. The drainage channel is situated behind the feed channel 65 in the plane of projection in FIG. 3 and is therefore not visible, but is nonetheless provided. In the example shown, the feed channel opening and the inlet opening 13*a* point towards each other and lie opposite each other. The drainage channel opening and the outlet opening 14*a* point towards each other and lie opposite each other.

The feed channel 65 is connected in fluid communication with the inlet 13 via a tubular connecting element 60 which is arranged between the feed channel 65 and the inlet 13. The drainage channel is connected in fluid communication with the outlet 14 by means of a tubular connecting element 70 which is arranged between the drainage channel and the outlet 14.

As can be seen for example from FIG. 2, the connecting element 60 is inserted into the inlet 13, and the connecting element 70 is inserted into the outlet 14. The inlet 13 comprises an inner circumferential surface, and the connecting element 60 comprises an outer circumferential surface, wherein a sealing ring 61 is arranged between the inner circumferential surface and the outer circumferential surface and abuts them, forming a seal, in order to seal off the gap formed between them. This seals off the inlet 13 in relation to the accommodating space 104.

The outlet 14 comprises an inner circumferential surface, and the connecting element 70 comprises an outer circumferential surface, wherein a sealing ring 71 is arranged between the inner circumferential surface and the outer circumferential surface and abuts them, forming a seal, in order to seal off the gap formed between them. This seals off the outlet 14 in relation to the accommodating space 104. A reflux valve which is formed in the outlet 14 comprises a closing body 73 which is spherical in the example shown (FIG. 1) and is embodied to allow a flow of fluid from the pump chamber 15 to the drainage channel, i.e. when the closing body 73 is lifted off a valve seat, and to block a flow in the opposite direction from the drainage channel into the pump chamber 15, i.e. when the closing body 73 abuts the valve seat.

When the pump insert 1 is inserted into the accommodating space 104 (FIG. 3), the connecting element 60 is inserted into the feed channel 65 and the connecting element 70 is inserted into the drainage channel. The connecting elements 60, 70 each comprise an outer circumferential surface, and the feed channel 65 and the drainage channel each comprise an inner circumferential surface. The gap formed between the outer circumferential surface and the inner circumferential surface is sealed by a sealing ring 62, 72 (FIG. 1) in each case, such that the feed channel 65 and the drainage channel are sealed off in relation to each other and in relation to the accommodating space 104.

The connecting element 60 and the connecting element 70 comprise a seat, which is shaped as an annular groove and forms the outer circumferential surface which the sealing ring abuts, for each of the sealing rings 61, 62 and/or 71, 72.

The drive shaft 30 is mounted, such that it can rotate about the rotational axis D, by means of a first rotary bearing 16 and a second rotary bearing 17. The first rotary bearing 16 and the second rotary bearing 17 are each embodied as slide bearings in the example embodiment shown. The drive shaft 30 is supported on the housing cover 18*a* by means of the first rotary bearing 16 and on the housing cover 18*c* by means of the second rotary bearing 17, such that it can rotate about the rotational axis D. The housing cover 18*a*, 18*c* itself or a slide bearing bushing (not shown) which is attached, in particular press-fitted, in the housing cover 18*a*, 18*c* can for example form the rotary bearing 16, 17 which is embodied as a slide bearing.

Optionally, a third rotary bearing 9 (FIG. 3) can be provided which is for example arranged such that a rotor 21 of the electric motor 20 is situated and/or arranged between the first rotary bearing 16 or the second rotary bearing 17 and the third rotary bearing 9. The third rotary bearing 9 can for example be embodied as a roll bearing or slide bearing. The drive shaft 30 is in particular supported at one end, such that it can rotate, on an assembly structure 25 via the third rotary bearing 9. In embodiments with no rotary bearing 9, the rotor 21 can be cantilevered, i.e. the rotor 21 is attached in a region of the drive shaft 30 which is arranged outside the first and second bearings 16, 17 and not between the first and second bearings 16, 17.

The assembly structure 25 is connected to the pump housing 18, such that it is fixed against rotating about the rotational axis D and preferably also axially fixedly, namely by means of at least one connecting structure 26 (FIGS. 1 and 2) which is for example an elongated connecting structure. In the embodiments shown, the at least one elongated connecting structure 26 is embodied in the form of multiple stud-bolts. The connecting structure 26 extends parallel to the rotational axis D. The assembly structure 25 comprises a bore, in particular a threaded bore, in particular in the region of the circumference, for each connecting structure 26, into which an internal thread of the connecting structure 26 is screwed. The outer circumference of the stator 22 of the electric motor 20 comprises a passage or, as for example shown in FIGS. 1 and 2, a groove-shaped elongated recess for each of the connecting structures 26, wherein the connecting structure 26 extends through the groove-shaped recess in the longitudinal direction of the groove. This supports the stator 22, such that it is fixed against rotating about the rotational axis D, on the connecting structure 26. The pump housing 18, in particular the housing covers 18*a*, 18*c* and the housing base body 18*b*, comprise(s) a passage for each of the connecting structures 26, in which one of the connecting structures 26 is arranged. The housing cover 18*a*, the housing base body 18*b*, the housing cover 18*c* and the stator 22 are arranged and/or clamped between the assembly structure 25 and a head of the connecting structure 26 or a bolt nut which is screwed onto the connecting structure 26. In the embodiment shown in the figures, a first end-facing side of the stator 22 abuts the housing cover 18*c*, and a second end-facing side of the stator 22 abuts the assembly structure 25.

The electric motor 20 comprises the stator 22, which is connected or coupled to the pump housing 18 and the assembly structure 25 such that it is fixed against rotating about the rotational axis D and axially fixedly, and the rotor 21 which is non-rotationally connected to the drive shaft 30, in particular in a non-rotational engagement with the drive shaft 30. In the example embodiment shown in the figures, the rotor 21 is embodied as an internal rotor. The rotor 21 is surrounded by the stator 22. Alternative arrangements of the rotor 21 and the stator 22 are however possible in principle; thus, the rotor 21 can for example be embodied as an external rotor, i.e. such that the rotor 21 at least partially surrounds the stator 22.

The rotor 21 and the delivery element 11 are connected, in particular non-rotationally, via the drive shaft 30 in such a way that rotating the rotor 21 causes the delivery element 11 to rotate.

The stator 22 comprises multiple coils 23 over its circumference, to which electrical energy can be selectively applied, for example in groups (phases), thus generating magnetic fields which cause the rotor 21 to be rotated relative to the stator 22 about the rotational axis D.

The stator 22 encloses a motor space 52 of the electric motor 20, in which the rotor 21 is arranged. The stator 22 forms a part of the outer circumference or forms the outer side of the pump insert 1. In other words, the stator 22 delineates the accommodating space 104 in which the pump insert 1, in particular at least the pump 10 and the electric motor 20, is/are at least partially arranged.

As can be seen from FIG. 3, the housing cover 18*a* is open towards the accommodating space 104 in the region of the rotary bearing 16, such that there is a direct fluid-communication connection between the rotary bearing 16 and the accommodating space 104. The rotary bearings 16, 17 are not completely liquid-tight, such that so-called leakage fluid (leakage liquid) can flow out of the pump chamber 15 via the rotary bearing 16 and the rotary bearing 17 during delivery operations of the pump 10. In the embodiment shown in FIG. 3, the leakage fluid flowing through the rotary bearing 16 can be discharged directly into the accommodating space 104. The leakage fluid flowing through the rotary bearing 17 is first guided into the motor space 52 and then discharged from the motor space 52 via a motor space outlet 53. The motor space 52 is thus provided in order for fluid, in particular the leakage liquid such as for example oil, to be able to flow through it. This enables the components arranged in the motor space 52 to be cooled and/or lubricated and alternatively or additionally enables the assembly structure 25 to be cooled. In the embodiment shown in the figures, the pump insert 1 is configured in such a way that the leakage fluid coming from the pump chamber 15 is channeled into the motor space 52 and in particular flows through the motor space 52 and is discharged from the motor space 52 into the accommodating space 104 via the motor space outlet 53.

As shown in FIGS. 4 and 5, the motor space outlet 53 can for example be formed by the holding structure 25. The motor space outlet 53 is arranged laterally on the pump insert 1 (FIG. 5). A motor space outlet opening 53*a* points towards the circumferential wall 102 and emerges onto the outer circumference of the pump insert 1, in particular the outer circumference of the assembly structure 25.

The pump array can be embodied such that the fluid can be discharged from the accommodating space 104 into a storage container, such as for example a liquid or oil reservoir which can for example be a gear sump. The storage container can for example be connected in fluid communication with the accommodating space 104. To this end, the accommodating housing 100 can comprise a discharge channel (not shown) which emerges into the accommodating space 104 and leads to the storage container. The pump 10 can for example suction the liquid or the oil from the storage container via the inlet 13 and the feed channel 65.

As can be seen for example from FIG. 2, the pump insert 1 comprises a contact unit 40 which is arranged on the assembly structure 25, outside the accommodating space 104. The contact unit 40 comprises an electronics housing 41 which is fastened to the assembly structure 25 by means of multiple stud-bolts 46 (FIG. 1). A gasket 8 which is embodied as a sealing ring and arranged between the electronics housing 41 and the assembly structure 25 seals off an interior space in relation to the environment of the pump insert 1.

The pump insert 1 comprises a plate-shaped carrier 42, in particular a printed circuit board, which comprises control electronics 49 for controlling the electric motor 20. The control electronics 49 and/or the carrier 42 are arranged on the side of the assembly structure 25 facing away from the electric motor 20. The carrier 42 comprising the control electronics 49 is arranged in the interior space enclosed by the electronics housing 41 and the assembly structure 25.

In the example shown, the assembly structure 25 is formed from metal or a metal alloy, such as for example an aluminum alloy. A transmission of heat from the control electronics 49 to the assembly structure 25 is enabled by a thermal bridge formed between the assembly structure 25 and the control electronics 49 or individual components of the control electronics 49. The thermal bridge can be established by the carrier 42, and/or individual electronic components which require cooling during operation, abutting a surface of the assembly structure 25 which is formed from metal or a metal alloy. This enables thermal energy to be discharged from the control electronics 49 or components of the control electronics 49 into the assembly structure 25.

As can be seen from FIGS. 1 and 3, at least one thermally conductive element 44 can be arranged between the control electronics 49 or individual components of the control electronics 49, or between the carrier 42 and the assembly structure 25, in order to improve the transmission of heat from the control electronics 49 or components of the control electronics 49 into the assembly structure 25. The at least one thermally conductive element 44 can for example be thermally conductive paste or a thermally conductive pad. Multiple components of the control electronics 49 which are to be cooled can for example be connected to the assembly structure 25 by means of a common thermally conductive element 44 in order to form the thermal bridge. Alternatively or additionally, multiple thermally conductive elements 44 can be provided, wherein a thermally conductive element 44 which is assigned to an individual component can be provided for each of multiple components (see FIG. 1).

As can for example be seen from FIGS. 1 and 3, the electronics housing 41 comprises one or more hold-down elements 45 which protrude from its inner end-facing wall and press the carrier 42 against or onto the assembly structure 25. This can increase or improve the transfer of heat between the control electronics 49 and the assembly structure 25.

A thermal bridge is formed between the assembly structure 25 and the accommodating housing 100, via which heat can be transmitted from the assembly structure 25 into the accommodating housing 100. The assembly structure 25 comprises a flange which fastens the assembly structure 25 and therefore the pump insert 1 to the accommodating housing 100. The accommodating housing 100 comprises an assembly surface 101 which is in particular on an end-facing side and opposed by an end-facing side of the assembly structure 25 formed by the flange. The flange can be fastened to the accommodating housing 100 by means of one or more fastening means, for example stud-bolts, which tense the flange towards the accommodating housing 100. The assembly structure 25, in particular the flange of the assembly structure 25, can directly abut the accommodating housing 100. Alternatively, a thermally conductive element 105 can be arranged between the assembly structure 25, in particular the flange of the assembly structure 25, and the accommodating housing 100. The thermally conductive element 105 can in particular be thermally conductive paste or a thermally conductive pad. This improves or increases the transfer of heat between the assembly structure 25 and the accommodating housing 100.

The thermal bridge formed between the assembly structure 25 of the pump insert 1 and the accommodating housing 100, the assembly structure 25 and the thermal bridge formed between the assembly structure 25 and the control electronics 49 embodied to control the motor 20 are adjusted to each other such that heat generated in the control electronics 49 while the electric motor 20 is in operation is at least mostly discharged into the accommodating housing 100 via the thermal bridge formed between the control electronics 49 and the assembly structure 25, the assembly structure 25 and the thermal bridge formed between the assembly structure 25 and the accommodating housing 100.

The assembly structure 25 forms a cover which closes off the accommodating space 104. An annular gasket 7 which seals off the accommodating space 104 from the outside is arranged between the assembly structure 25 and the accommodating housing 100, in particular between the assembly surface 101 and the flange opposing the assembly surface 101 of the accommodating housing 100. The assembly structure 25 comprises a recess which is shaped as a groove, in particular an annular groove, and in which the annular gasket 7 is arranged. The annular gasket 7 abuts the annular groove on the one hand and the assembly surface 101 on the other, forming a seal, in order to seal off the accommodating space 104 in relation to the environment.

The contact unit 40 or the control electronics 49 is/are connected in an electrically conductive way to, i.e. contact(s), the coils 23 of the stator 22. As can be seen for example from FIG. 3, the assembly structure 25 is arranged between the contact unit 40 and the rotor 21 and/or the stator 22. The assembly structure 25 comprises multiple passages 28 for one contact element 47, in particular a contact tongue, each. The passage 28 is formed by a sealing element 27, which can for example be a rubber gasket or a subsequently introduced sealing or potting compound. In the example shown in FIG. 3, each of the contact elements 47 formed on the stator 22 projects from the stator 22 towards the contact unit 40 and respectively extends through one of the passages 28. The contact unit 40, in particular the control electronics 49, comprise(s) multiple complementary contact elements 24, each of which is connected in an electrically conductively way to, i.e. contacts, a coil 23 or a group of coils 23. Each of the contact elements 47 extending through the passage 28 is assigned to one of the complementary contact elements 24, with which it forms a plug connection for electrically contacting the control electronics 49 or the contact unit 40 in general. The contact elements 47 and complementary contact elements 24 can for example be plugged together by attaching the assembly structure 25 together with the contact unit 40 on the stator 22, for example by affixing them in the axial direction along the rotational axis D. The contact elements 47 extend through the assembly structure 25, namely through the passages 28, wherein the complementary contact elements 24 are arranged on the side of the assembly structure 25 facing away from the electric motor 20, for example in the interior space enclosed by the electronics housing 41 and the assembly structure 25.

Alternatively, the contact element 47 can be formed on the carrier 42 and protrude from the carrier 42 through the passage 28. The complementary contact elements 24 can be formed on the stator 22 and can electrically contact the contact element 47 on the side of the assembly structure 25 facing the stator 22.

The contact unit 40 comprises at least one electrical plug connector 43. The at least one electrical plug connector 43 can be formed at least in part by the electronics housing 41 and/or serves to supply the control electronics 49 and/or the coils 23 with electrical energy. The electrical plug connector 43 is arranged outside the accommodating space 104.

LIST OF REFERENCE SIGNS

1 pump insert
7 gasket/sealing ring
8 gasket/sealing ring
9 third rotary bearing
10 pump
11 first delivery element/toothed wheel
12 second delivery element/internally toothed wheel
13 inlet
13*a* inlet opening
14 outlet
14*a* outlet opening
15 pump chamber
16 first rotary bearing/slide bearing
17 second rotary bearing/slide bearing
18 pump housing
18*a* first housing cover
18*b* housing base body
18*c* second housing cover
19 centering pin
20 electric motor
21 rotor
22 stator
23 coil
24 complementary contact element
25 assembly structure
25*a* contact surface
26 connecting structure
27 sealing element
28 passage
30 drive shaft
40 contact unit
41 electronics housing
42 carrier
43 electrical plug connector
44 thermally conductive element
45 hold-down element
46 stud bolt
47 contact element/contact tongue
49 control electronics
52 motor space
53 motor space outlet
53*a* motor space outlet opening
60 connecting element
61 sealing ring
62 sealing ring
65 feed channel
70 connecting element
71 sealing ring
72 sealing ring
73 closing body
100 accommodating housing
101 assembly surface
102 circumferential wall
103 end-facing wall
104 accommodating space
105 thermally conductive element
D rotational axis

The invention claimed is:

1. A pump array, comprising an accommodating housing which forms an accommodating space with an end-facing wall and a circumferential wall and a pump insert, which is at least partially arranged in the accommodating space, the pump insert comprising:

a pump comprising a pump chamber and a delivery element which is rotatable about a rotational axis and which is arranged in the pump chamber;

an electric motor comprising a rotor, which is rotatable about the rotational axis, and a stator;

a drive shaft which is mounted such that it is rotatable about the rotational axis, wherein the rotor and the delivery element are connected via the drive shaft in such a way that rotating the rotor causes the delivery element to rotate; and an inlet, which is embodied to feed fluid to the pump chamber, and/or an outlet, which is adapted to discharge fluid from the pump chamber, on the side pointing towards the end-facing wall of the accommodating space, wherein the end-facing wall of the accommodating housing comprises a feed channel and a drainage channel; and wherein the pump array further comprises a tubular connecting element, which is adapted to be inserted into the feed channel from the side of the accommodating space and which is inserted into the inlet and arranged between the feed channel and the inlet and connects them in fluid communication, and a tubular connecting element, which is adapted to be inserted into the drainage channel from the side of the accommodating space and which is inserted into the outlet and arranged between the drainage channel and the outlet and connects them in fluid communication.

2. The pump insert according to claim 1, wherein the pump insert comprises an assembly structure using which the pump insert can be fastened to the accommodating housing.

3. The pump insert according to claim 2, wherein the pump insert comprises control electronics for controlling the electric motor, wherein a thermal bridge is formed between the control electronics and the assembly structure, via which heat can be transmitted from the control electronics to the assembly structure.

4. The pump insert according to claim 3, wherein a thermally conductive element is arranged between the control electronics and the assembly structure.

5. The pump insert according to claim 3, wherein the control electronics are arranged at least partially on a carrier, wherein in the region of (each of) one or more components of the control electronics, a thermally conductive element is arranged between the component and the assembly structure and/or one or more thermally conductive elements are arranged between the carrier and the assembly structure.

6. The pump insert according to claim 2, further comprising an electronics housing which is fastened to the assembly structure and in which control electronics for the electric motor are arranged, wherein the electronics housing comprises one or more hold-down elements which press a carrier, on which the control electronics are at least partially arranged, against or onto the assembly structure.

7. The pump insert according to claim 4, wherein the assembly structure comprises at least one passage through which at least one contact element extends which electrically contacts the control electronics unit and at least one coil of the stator.

8. The pump insert according to claim 2, wherein the drive shaft is supported on the assembly structure such that it can rotate about the rotational axis.

9. The pump insert according claim 1, wherein the pump insert comprises a motor space outlet which connects a motor space, which is surrounded by the stator on the circumferential side, in fluid communication with the outer side of the pump insert and/or emerges onto the outer side.

10. The pump array according to claim 2, wherein a thermal bridge is formed between the assembly structure and the accommodating housing, via which heat can be transmitted from the assembly structure to the accommodating housing.

11. The pump array according to claim 2, wherein the assembly structure abuts the accommodating housing.

12. The pump array according to claim 2, wherein a thermally conductive element is arranged between the assembly structure and the accommodating housing.

13. The pump array according to claim 1, wherein a thermal bridge formed between an assembly structure of the pump insert and the accommodating housing, the assembly structure and a thermal bridge formed between the assembly structure and control electronics embodied to control the motor are adjusted to each other such that the heat generated in the control electronics while the electric motor is in operation is or can be at least mostly discharged into the accommodating housing via the thermal bridge formed between the control electronics and the assembly structure, via the assembly structure and via the thermal bridge formed between the assembly structure and the accommodating housing.

14. The pump array according claim 2, wherein the assembly structure forms a cover which closes off the accommodating space, and/or an annular gasket which seals off the accommodating space from the outside is arranged between the assembly structure and the accommodating housing.

15. The pump array according to claim 2, wherein the assembly structure is flange-mounted to the accommodating housing.

16. The pump array according to claim 2, wherein the assembly structure, comprises a motor space outlet which connects a motor space, which is surrounded by the stator on the circumferential side, in fluid communication with the accommodating space.

17. The pump array according to claim 16, wherein the motor space outlet is arranged laterally on the pump insert, or the motor space outlet emerges onto the outer side of the assembly structure via an opening of the motor space outlet pointed towards the circumferential wall.

18. The pump array according to claim 1, wherein the accommodating housing comprises a discharge channel which emerges into the accommodating space and via which fluid can be discharged from the accommodating space or a storage container.

19. The pump array according to claim 1, wherein the accommodating space is sealed off in relation to the inlet and the outlet.

20. The pump array according to claim 1, wherein the stator forms at least a part of the outer circumference or the outer side of the pump insert and/or delineates the accommodating space.

21. The pump array according to claim 2, wherein at least one of the assembly structure and the accommodating housing is made of metal or a metal alloy.

22. The pump array according to claim 4, wherein the thermally conductive element comprises a thermally conductive paste or a thermally conductive pad.

23. The pump array according to claim 5, wherein the carrier comprises a printed circuit board.

24. The pump array according to claim 6, wherein the electronics housing is made of plastic.

25. The pump array according to claim 15, wherein the assembly structure is fastened to the accommodating housing by means of at least one stud-bolt.

* * * * *